US006813811B2

(12) United States Patent
Matsuki et al.

(10) Patent No.: US 6,813,811 B2
(45) Date of Patent: Nov. 9, 2004

(54) DOOR CHECKER FOR AUTOMOBILE

(75) Inventors: Katsuhiro Matsuki, Saitama (JP); Takahiro Ohno, Saitama (JP); Hiroshi Tokuyama, Saitama (JP)

(73) Assignees: Rikenkaki Kogyo Kabushiki Kaisha, Saitama (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/269,919

(22) Filed: Oct. 11, 2002

(65) Prior Publication Data

US 2003/0101537 A1 Jun. 5, 2003

(30) Foreign Application Priority Data

Oct. 16, 2001 (JP) ..... 2001-318633

(51) Int. Cl.[7] ..... E05F 5/06

(52) U.S. Cl. ..... 16/86 B; 16/86 C

(58) Field of Search ..... 16/86 B, 86 C, 16/86 R, 86 A; 292/277, 262, 265, DIG. 19; 296/146.12, 146.11

(56) References Cited

U.S. PATENT DOCUMENTS

| | | | | | |
|---|---|---|---|---|---|
| 4,858,952 | A | * | 8/1989 | Sasaki et al. | 280/802 |
| 5,074,010 | A | * | 12/1991 | Gignac et al. | 16/334 |
| 5,152,030 | A | * | 10/1992 | Cogo | 16/86 C |
| 5,173,991 | A | * | 12/1992 | Carswell | 16/86 A |
| 5,474,344 | A | * | 12/1995 | Lee | 292/262 |
| 5,862,570 | A | * | 1/1999 | Lezuch et al. | 16/82 |
| 6,446,305 | B1 | * | 9/2002 | Kneeland | 16/82 |

FOREIGN PATENT DOCUMENTS

| | | | | |
|---|---|---|---|---|
| DE | 2406906 | A | * | 8/1975 |
| DE | 3511406 | A1 | * | 10/1986 |
| DE | 3906041 | A1 | * | 8/1990 |
| EP | 0326823 | A1 | * | 8/1989 |
| EP | 643185 | A1 | * | 3/1995 |
| JP | 55106837 | A | * | 8/1980 |
| JP | 07-101246 | | | 4/1995 |
| JP | 09235929 | A | * | 9/1997 |
| JP | 09291743 | A | * | 11/1997 |
| JP | 11303487 | A | * | 11/1999 |
| JP | 2001-12127 | | * | 1/2001 |
| JP | 2002106237 | A | * | 4/2002 |

* cited by examiner

*Primary Examiner*—Chuck Y. Mah
(74) *Attorney, Agent, or Firm*—Carrier, Blackman & Associates, P.C.; Joseph P. Carrier; William D. Blackman

(57) ABSTRACT

A door checker for an automobile includes a case secured to a door, and a check plate mounted to extend through the case and supported on a body. A pair of detent members and resilient members for urging the detent members against opposite sides of the check plate are accommodated in the case. The check plate is provided with notches in which the detent members are brought into engagement to retain the door at a predetermined medium opening degree, and with a full-opening stopper adapted to receive an outer side of the case to define an opening limit for the door. In the door checker, a section of each of the opposite sides of said check plate, where each of the detent members is moved from the medium opening degree to the opening limit for the door, is formed as a continuous surface having no unevenness. Thus, a door-opening load can be prevented from changing quickly during movement of the door from a predetermined medium opening degree to the opening limit, thereby preventing the quick opening of the door to the opening limit against a user's wish.

10 Claims, 4 Drawing Sheets

DOOR CHECKER FOR AUTOMOBILE

BACKGROUND OF THE INVENTION

1. Field of the Invention

The present invention relates to an improvement in a door checker for an automobile, comprising a case secured to one of a body and a door of the automobile, and a check plate mounted movably to extend through the case and supported on the other of the body and the door, a pair of detent members and a pair of resilient means or members or mechanisms being accommodated in the case, the detent members being mounted to come into contact with opposite sides of the check plate, the resilient means being adapted to exhibit repulsive forces to urge the detent members against the opposite sides of the cheek plate, the check plate being provided with notches in which the detent members are brought into engagement to retain the door at a predetermined medium opening degree, and with a full-opening stopper adapted to receive an outer side of the case to define an opening limit for the door.

2. Description of the Related Art

A conventional door checker for an automobile is already known, as disclosed, for example, in Japanese Patent Application Laid-open No. 7-101246.

In the known door checker for the automobile, in order to reliably retain the door at the opening limit, the notches are defined on the opposite sides of the check plate, so that the detent members are brought into engagement in the notches, when the door reaches the opening limit.

In such a structure, however, the door-opening load is decreased quickly by reason of that the detent members are dropped into the notches just before the opening limit for the door and hence, there is a tendency that the door is opened quickly to the opening limit against the user's wish, whereby the door may be brought into contact with another object. Especially, such tendency is marked, when the door's own weight is applied in the direction to open the door as the door is opened to the opening limit, due to the attitude and the like of the door mounted to the body.

SUMMARY OF THE INVENTION

Accordingly, it is an object of the present invention to provide a door checker for an automobile, wherein the door-opening load is prevented from being changed quickly during movement of the door from a predetermined medium opening degree to the opening limit, whereby the door can be prevented from being opened quickly against the user's wish.

To achieve the above object, according to a first feature of the present invention, there is provided a door checker for an automobile, comprising a case secured to one of a body and a door of the automobile, and a check plate mounted movably to extend through the case and supported on the other of the body and the door, a pair of detent members and resilient means being accommodated in the case, the detent members being mounted to come into contact with opposite sides of the check plate, the resilient means being adapted to exhibit repulsive forces to urge the detent members against the opposite sides of the check plate, the check plate being provided with notches in which the detent members are brought into engagement to retain the door at a predetermined medium opening degree, and with a full-opening stopper means adapted to receive an outer side of the case to define an opening limit for the door, wherein a section of each of the opposite sides of the check plate, where each of the detent members is moved from the medium opening degree to the opening limit for the door, is formed as a continuous surface having no unevenness.

With such arrangement of the first feature, the section of each of the opposite sides of the check plate, where each of the detent members is moved from the medium opening degree to the opening limit for the door, is formed as the continuous surface having no unevenness. Therefore, it is possible to suppress any sudden or quick change in door-opening load during movement of the door from the medium opening degree to the opening limit, thereby preventing the quick opening of the door to the opening limit against a user's wish.

According to a second feature of the present invention, in addition to the first feature, the continuous surfaces are formed as slants rising toward the opening limit for the door.

With such arrangement of the second feature, as the door is opened from the medium opening degree toward the opening limit, the detent members are moved up the slants of the check plate, whereby repulsive forces of the resilient means are gradually increased to gradually increase the frictional forces between the slants and the detent members. As a result, it is possible to suppress the natural opening tendency of the door due to its own weight as the door approaches the opening limit.

According to a third feature of the present invention, in addition to the second feature, the slants are formed to generate frictional forces between the slants and the detent members for retaining the door at the opening limit.

With such arrangement of the third feature, it is possible to prevent the voluntary movement of the door which is in a fully opened state due to an external force equal to or smaller than a given value such as wind pressure and the like.

The resilient means, the notches and the slants correspond to rubber springs 17, second notches 11 and second slants 22 respectively in an embodiment of the present invention which will be described hereinbelow.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment with reference to the accompanying drawings.

Figure 1:
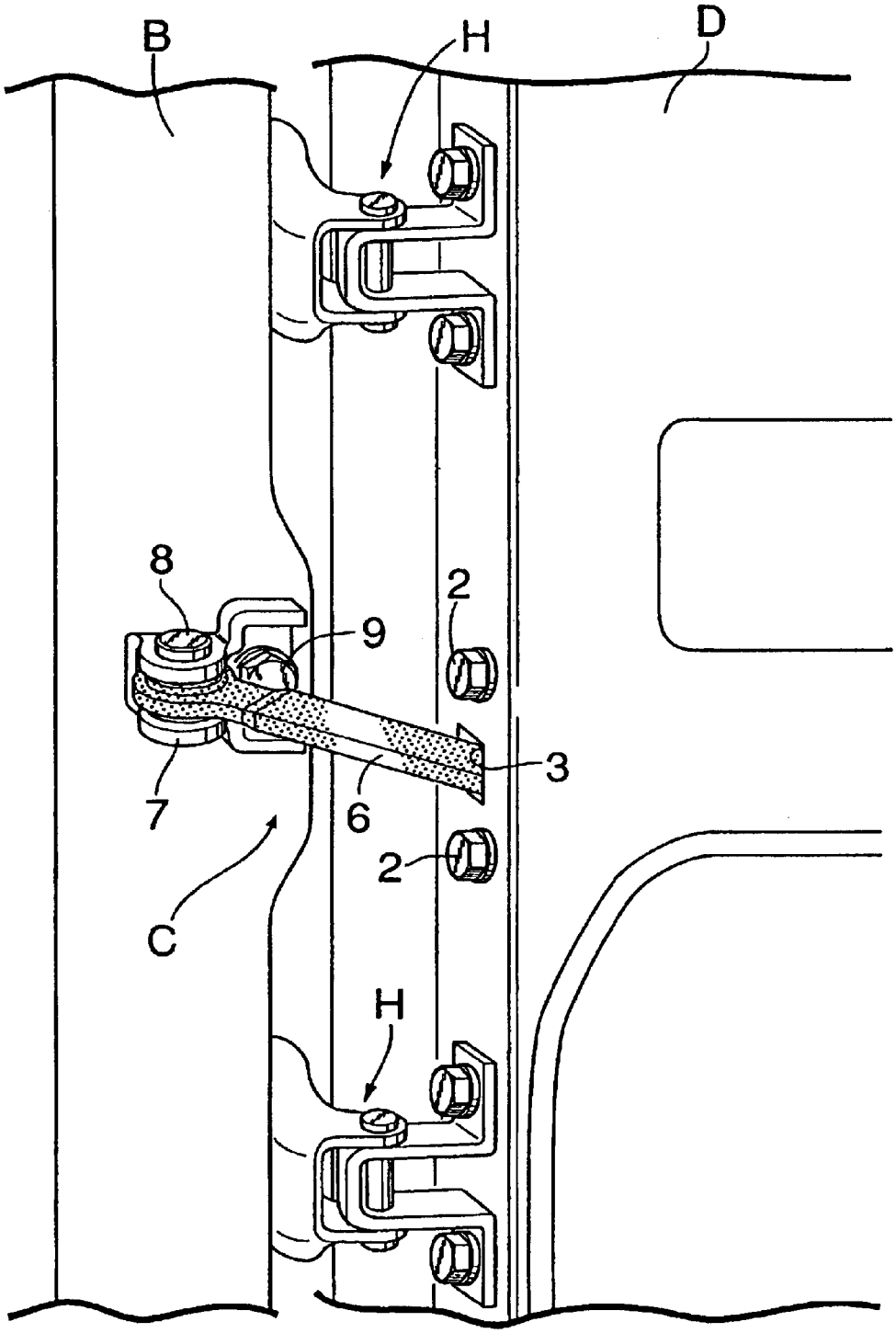
FIG. 1 is a perspective view of essential portions of an automobile provided with a door checker according to the present invention.

Referring first to FIG. 1, a door D is swingably mounted to a body B of an automobile with a pair of upper and lower hinges H, H interposed therebetween in order to open and close a doorway, and a door checker C according to the present invention is mounted to the body B and the door D between both the hinges H, H.

Figure 2B:
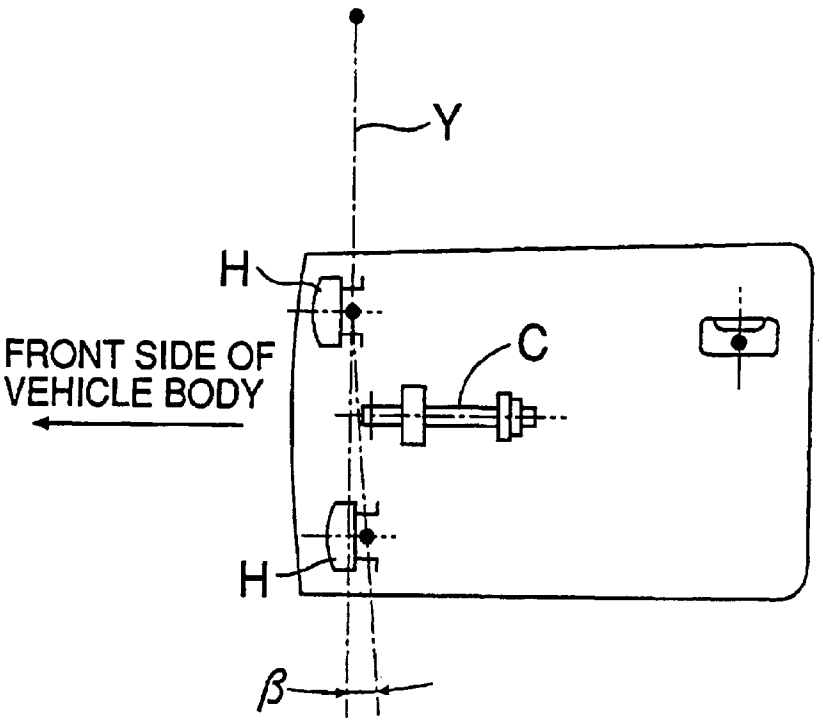
FIGS. 2A and 2B are views of a front end face and an inner side of a door connected to a body of the automobile.
Figure 2A:
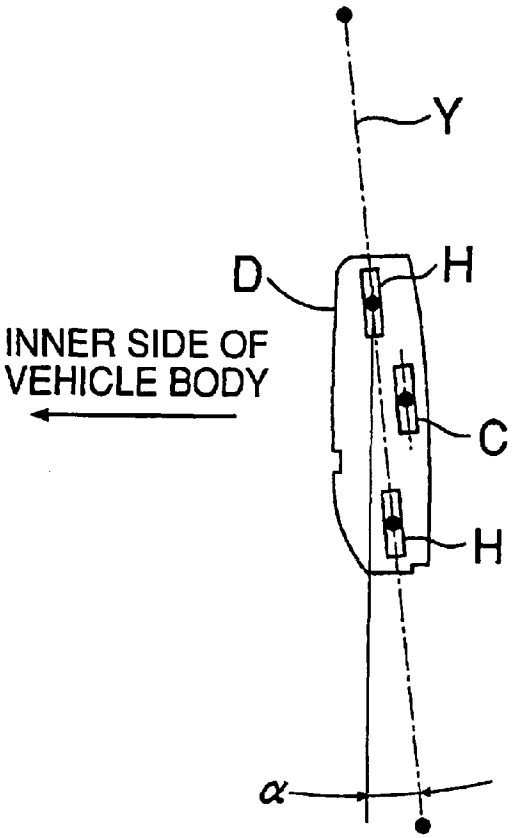

In this case, each of the hinges H, H is disposed so that its turning axis Y is inclined at an angle α inwards of the body B with respect to a vertical direction as viewed from the back of the door D, as shown in FIG. 2A, and is inclined at an angle β forwards of the body B with respect to a vertical direction as viewed from the side of the door D. If the hinges H, H are disposed in the above manner, the door D assumes a rearward-rising attitude upon opening thereof and thus, a space between a lower portion of a free end of the opened door D and the doorway in the automobile is wider to facilitate the getting-on/off of a user. However, if the door D exceeds a certain medium opening degree, its own weight is applied in a direction to open the door D.

Figure 3:
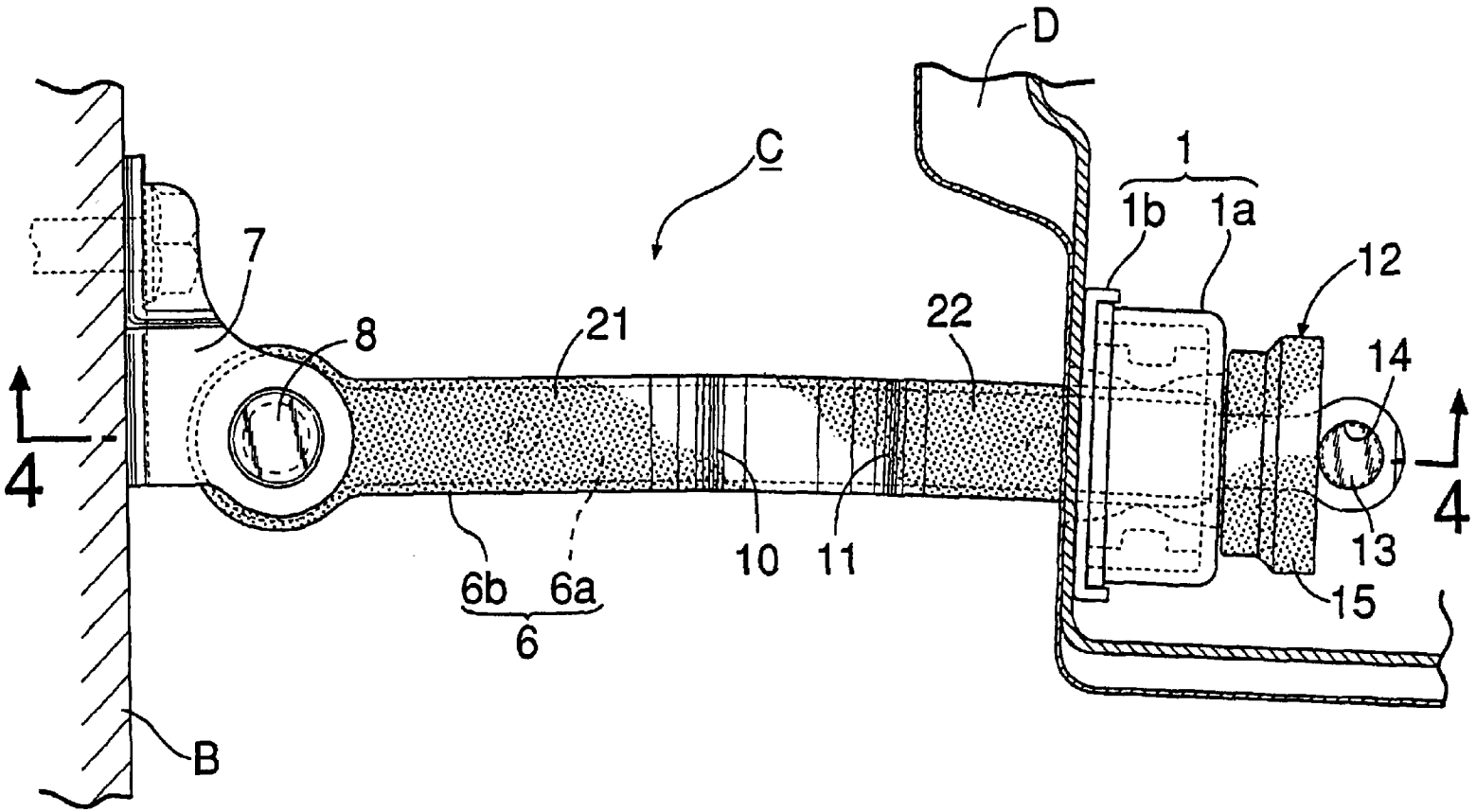
FIG. 3 is a plan view showing a door checker in a fully opened state of the door.
Figure 4:
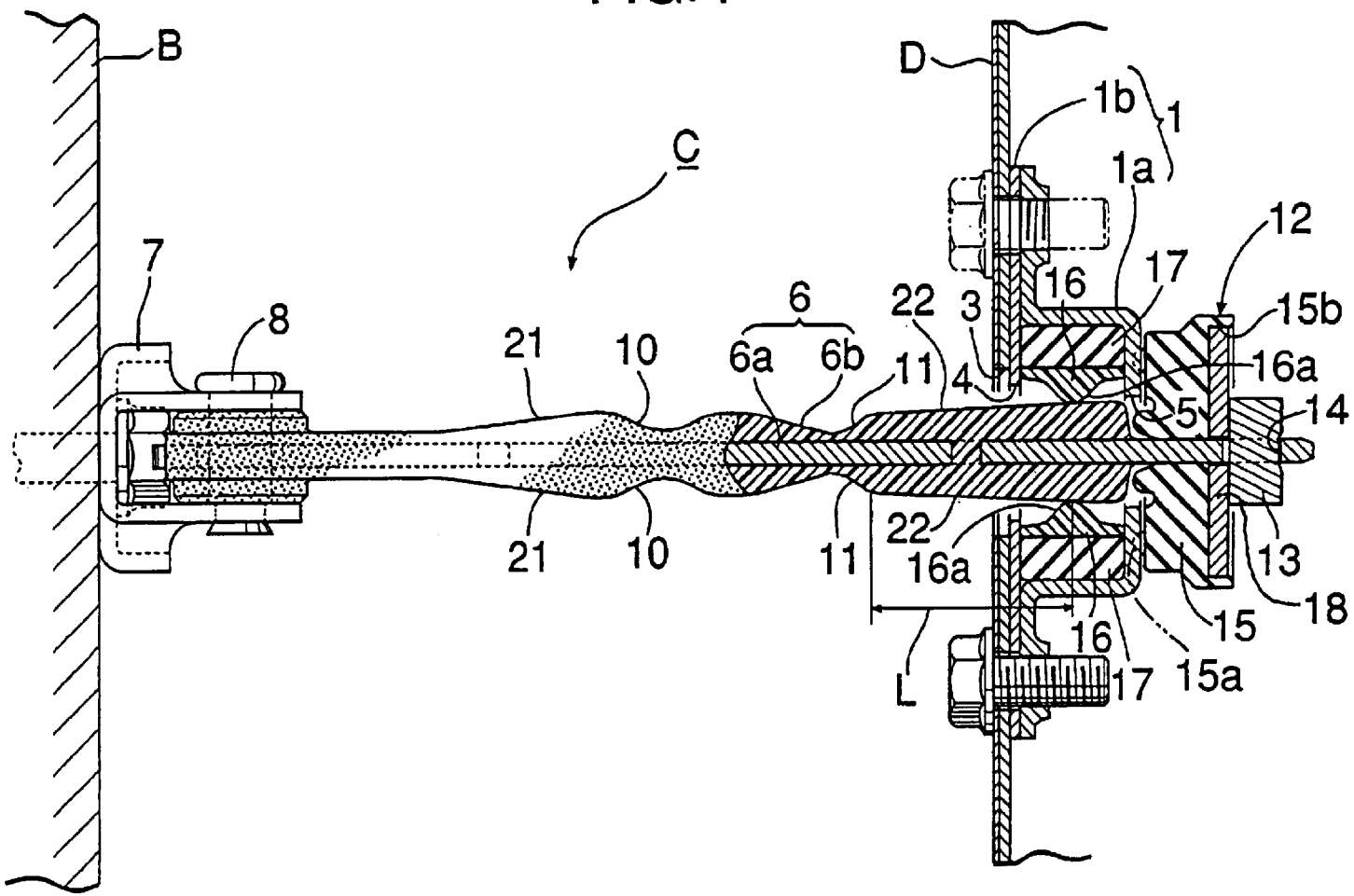
FIG. 4 is a sectional view taken along a line 4—4 in FIG. 3.

The construction of the door checker C according to the present invention will be described below with reference to FIGS. 3 and 4. The door checker C includes a case 1 secured to an inner surface of an end wall of the door D by bolts 2. The case 1 comprises a box-shaped case body 1*a* with one end opened, and a cover 1*b* clamped between the case body 1*a* and the inner surface of the end wall of the door D to cover the opened end of the case body 1*a*. Through-bores 4 and 5 are provided in the cover 1*b* and the case body 1*a* and arranged coaxially with a through-bore 3 opening into the end wall of the door D. A check plate 6 passed through the three through-bores 3, 4 and 5 is relatively turnably connected at its base end to a bracket 7 through a pivot 8. The bracket 7 is secured to the body B by a bolt 9 with the pivot 8 disposed in parallel to pivot axes of the hinges H.

The check plate 6 is comprised of a plate body 6*a* made of a steel plate and connected directly to the bracket 7, and a covering portion 6*b* made of a synthetic resin and mold-coupled to a peripheral surface of the plate body 6*a* excluding a free end thereof. First and second notches 10, 10; 11, 11 are provided on widthwise opposite sides of the check plate 6 at lengthwise intermediate locations in the named order from its base end. A section from the base end of the check plate 6 to the first notches 10, 10 is formed as first slants 21 rising toward the first notches 10, 10. The first notches 10, 10 and the first slants 21 are formed simultaneously with the formation of the covering portion 6*b*.

A full-opening stopper 12 defines an opening limit for the door D and is mounted at the free end of the check plate 6. The full-opening stopper 12 comprises a cushion member 15 elastically fitted to the free end of the check plate 16, a support plate 18 which receives a back of the cushion plate 15, and a stopper pin 13 mounted in a pinhole 14 in the free end of the check plate 6 to fix the support plate 18 to the check plate 6. The cushion member 15 is formed into a disk shape from an elastic material such rubber, elastomer and the like and has a large number of buffering projections 15*a* provided on its front surface, and a recess 15*b* provided in its back, so that the support plate 18 is fitted into the recess 15*b*.

Second slants 22, 22 continuous with no unevenness are formed on the opposite sides of the check plate 6 in a section L from the second notches 11, 11 to the full-opening stopper 12 and expand or rise toward the full-opening stopper means 12.

On the other hand, accommodated in the case 1 are a pair of detent members 16, 16 made of a synthetic resin and disposed to sandwich the cheek plate 6 in its widthwise direction, and a pair of rubber springs 17, 17 as a resilient means or members or mechanisms for repulsing the detent members 16, 16 to bring them into pressure contact with opposite sides of the check plate 6, respectively.

Semi-cylindrical engage projections 16*a*, 16*a* are formed on opposed front surfaces of the detent members 16, 16 to extend in the widthwise direction of the check plate 6, and adapted to be slid on the opposite sides of the check plate 6 and to be brought into engagement in the first and second notches 10, 10, 11, 11.

The gradient of the second slants 22, 22 of the check plate 6 and the preset loads of the rubber springs 17, 17 are set so that frictional forces capable of retaining the door D at an opening limit is generated between the check plate 6 and the detent members 16, 16.

The operation of the present embodiment will be described below.

In a closed state of the door D, the pair of detent members 16, 16 of the door checker C are in pressure contact with the opposite sides of the covering portion 6*b* at points where the thickness of the check plate 6 is relatively small under the action of repulsive forces of the rubber springs 17, 17.

When the door D is opened from this state, the engage projections 16*a*, 16*a* of the detent members 16,16 are moved up the first slants of the covering portion 6*b*, while slipping thereon in response to the opening of the door D, whereby the rubber springs 17, 17 are compressed. Therefore, urging forces of the detent members 16, 16 applied to the check plate 6 are increased by an increase in repulsive forces of the rubber springs 17, 17, whereby the load for opening the door D is increased moderately.

When the door D is opened up to the first medium opening degree and the detent members 16, 16 reach positions where they are opposed to the first notches 10, 10, the engage projections 16*a*, 16*a* of the detent members 16, 16 are brought into engagement in the notches 10, 10 by the repulsive forces of the rubber springs 17, 17, and the door D can be retained at the first medium opening degree by resulting engagement forces.

When the opening force for the door D is further increased, the detent members 16, 16 are disengaged from the first notches 10, 10, while compressing the rubber springs 17, 17 again, to move toward the second notches 11. When the door D is thus opened up to a predetermined second medium opening degree and the detent members 16, 16 reach positions where they are opposed to the second notches 11, the engage projections 16*a*, 16*a* of the detent members 16, 16 are brought into engagement in the second notches by the repulsive forces of the rubber springs 17, 17, and the door D can be retained at the second medium opening degree by resulting engagement forces.

When the opening force for the door D is further increased again, the detent members 16, 16 are disengaged from the second notches 11,11 and are moved, this time, up the second slants 22 of the check plate 6, while slipping thereon, whereby the rubber springs 17, 17 are gradually compressed again. Thus, the urging forces of the detent members 16, 16 applied to the check plate 6, i.e., the frictional forces between both the detent members 16, 16 and the check plate 6 are gradually increased by the gradual increase in repulsive forces. In the course of increasing the frictional forces, the cushion member 15 receives the case 1 in a buffering manner, whereby the door reaches the opening limit. Therefore, a sudden change in door-opening load is suppressed during movement of the door from the second medium opening degree to the opening limit, and the door can be prevented from being opened quickly against a user's wish and undesirably brought into contact with another object.

Especially, because the frictional forces between the detent members 16, 16 and the check plate 6 are gradually increased during movement of the door D from the second medium opening degree to the opening limit, the door D, after exceeding a certain medium opening degree, can be prevented reliably from being naturally opened from the second medium opening degree to the opening limit, even if its own weight is applied in the direction to open the door D, as described above.

Moreover, the frictional forces capable of retaining the door D at the opening limit are generated between the check plate 6 and the detent members 16, 16 by selecting the gradient of the second slants 22 and the preset load of the rubber springs 17,17, and hence, when the door D is in its fully opened state, the voluntary movement of the door can be prevented even if the door D receives an external force equal to or smaller than a given value due to a wind pressure or the like.

Although the embodiment of the present invention has been described in detail, it will be understood that the present invention is not limited to the above-described embodiment, and various modifications in design may be made without departing from the spirit and scope of the invention defined in the claims.

For example, the case 1 may be secured to the body B, and the bracket 7 of the check plate 6 may be mounted to the door D. In addition, a roller may be mounted to each of the detent members 16 in place of the engage projection 16*a*, and a metal spring may be used in place of the rubber spring 17.

What is claimed is:

1. A door checker for an automobile, comprising a case secured to one of a body and a door of the automobile, and a check plate mounted movably to extend through said case and supported on the other of said body and said door, a pair of detent members and resilient means being accommodated in said case, said detent members being mounted to come into contact with opposite sides of said check plate, said resilient means being adapted to exhibit repulsive forces to urge said detent members against the opposite sides of said check plate, said check plate being provided with notches in which said detent members are brought into engagement to retain the door at a predetermined medium opening degree, and with a full-opening stopper means adapted to receive an outer side of said case to define an opening limit for the door, wherein a section of each of the opposite sides of said check plate, corresponding to an area where each of said detent members is moved from the medium opening degree to the opening limit for the door, is formed as a continuous surface having no unevenness.

2. A door checker for an automobile according to claim 1, wherein said continuous surfaces are formed as slants rising toward the opening limit for the door.

3. A door checker for an automobile according to claim 2, wherein said slants are formed to generate frictional forces between said slants and said detent members for retaining the door at the opening limit.

4. A door checker for an automobile according to claim 1, wherein said door of the automobile is of a type having its own weight acting on the door in an opening direction thereof at near said opening limit, and engagement between said detent members and said sections of said check plate substantially prevent a door opening load from changing quickly during movement of the door from the medium opening degree to the opening limit of the door.

5. A door checker for an automobile according to claim 1, wherein a gradient of said continuous surfaces and preset loads of said resilient means are set so that frictional forces capable of retaining the door at the opening limit are generated between said check plate and said detent members.

6. A door checker for an automobile, comprising a case secured to one of a body and a door of the automobile, and a check plate mounted movably to extend through said case and supported on the other of said body and said door, a pair of detent members and resilient members being accommodated in said case, said detent members being mounted to come into contact with opposite sides of said check plate, said resilient members being adapted to exhibit repulsive forces to urge said detent members against the opposite sides of said check plate, said check plate being provided with notches in which said detent members are brought into engagement to retain the door at a predetermined medium opening degree, and with a full-opening stopper adapted to receive an outer side of said case to define an opening limit for the door, wherein a section of each of the opposite sides of said check plate, corresponding to an area where each of said detent members is moved from the medium opening degree to the opening limit for the door, is formed as a continuous surface having no unevenness.

7. A door checker for an automobile according to claim 6, wherein said continuous surfaces are formed as slants rising toward the opening limit for the door.

8. A door checker for an automobile according to claim 7, wherein said slants are formed to generate frictional forces between said slants and said detent members for retaining the door at the opening limit.

9. A door checker for an automobile according to claim 7, wherein a gradient of said continuous surfaces and preset loads of said resilient means are set so that frictional forces capable of retaining the door at the opening limit are generated between said check plate and said detent members.

10. A door checker for an automobile according to claim 6, wherein said door of the automobile is of a type having its own weight acting on the door in an opening direction thereof at near said opening limit, and engagement between said detent members and said sections of said check plate substantially prevent a door opening load from changing quickly during movement of the door from the medium opening degree to the opening limit of the door.

* * * * *